US006059903A

United States Patent [19]

Roloff et al.

[11] Patent Number: 6,059,903

[45] Date of Patent: May 9, 2000

[54] METHOD OF COOLING SECTIONAL GIRDERS

[75] Inventors: Wolfgang Roloff, Mönchengladbach; Lutz Kümmel, Jüchen; Rolf Stodt, Kaarst; Heinz-Jürgen Oudehinken, Düsseldorf; Meinert Meyer, Erkrath; Hans-Georg Hartung, Pulheim, all of Germany

[73] Assignee: SMS Schloemann-Siemag Aktiengesellschaft, Düsseldorf, Germany

[21] Appl. No.: 08/853,615

[22] Filed: May 9, 1997

[30] Foreign Application Priority Data

May 15, 1996 [DE] Germany ..... 196 19 574

[51] Int. Cl.[7] ..... C12D 8/00

[52] U.S. Cl. ..... 148/644; 148/660; 148/654; 148/511

[58] Field of Search ..... 148/654, 644, 148/639, 579, 627, 660, 511

[56] References Cited

U.S. PATENT DOCUMENTS

| | | | |
|---|---|---|---|
| 5,191,778 | 3/1993 | Inagaki et al. | 148/511 |
| 5,382,306 | 1/1995 | Plata et al. | 148/511 |

FOREIGN PATENT DOCUMENTS

| | | | |
|---|---|---|---|
| 0197825 | 10/1985 | Japan | 148/511 |
| 404103720 | 4/1992 | Japan | 148/511 |

*Primary Examiner*—Deborah Yee
*Attorney, Agent, or Firm*—Friedrich Kueffner

[57] ABSTRACT

A method of cooling section steel, particularly sectional steel girders, from rolling heat, wherein, prior to a final air cooling, a water cooling process is carried out in such a way that section steel portions with material concentrations are cooled at outwardly projecting portions of the steel sections over a width of application and a duration of application which are variable and subject to a predetermined cooling strategy supported by a process computer to a value which is at least still slightly above the transformation temperature Ar1.

5 Claims, No Drawings

METHOD OF COOLING SECTIONAL GIRDERS

BACKGROUND OF THE INVENTION

1. Field of the Invention

The present invention relates to a method of cooling section steel, particularly sectional steel girders, from rolling heat.

2. Description of the Related Art

Cooling of section steel, such as sectional steel girders, for example, double T sections and U sections, angle steel, T sections, after rolling is conventionally carried out by means of a cooling bed. Because of the uncontrolled, frequently unfavorable free cooling of the sectional girders or rods during the time when the girders or rods are on the cooling bed, a disadvantageous influence on the straightness and the inherent stress condition is unavoidable in most cases. This is because there is a close causal relationship between the straightness or inherent shape and the inherent stress condition.

Taken together, the two quality criteria mentioned above with respect to sectional girders can be compared to the planeness in the case of strip rolling. However, while the significance of a good planeness is to be seen primarily under geometrical aspects in the case of strips, the length differences of the fibers over the cross-section in the case of comparatively stiff sections may only result in a curvature, but will with certainty result in a sometimes significant reduction of the load carrying capacity due to inherent stresses.

In addition to a reduced load carrying capacity when external loads act on the steel, structural components with inherent stress also are subject to greater distortions during further processing because of the resulting interference with the state of equilibrium and also have a greater tendency to form cracks in areas with great differences in inherent stress, as they may occur particularly in the transition area between a web and a flange, for example, in double T sections.

The present invention is based on the following considerations and findings concerning the mechanism of the creation of inherent stresses. A rolled sectional girder leaves the last roll stand with a good approximation of a homogenous elongation distribution; this means that the girder or rod is straight and has no areas of waviness. In the case of dynamically recrystallizing materials, the girder or rod is essentially free of inherent stresses because of the high temperature level. On the other hand, in the case of a suppressed dynamic recrystallization, which is an important prerequisite for thermomechanical rolling, the inherent stress situation which is characteristic for the last pass reductions is established.

The temperature distribution after the last rolling is usually distinctly inhomogeneous; especially at the locations with material concentrations, a section cools to a lesser extent than in the areas having thin walls. Independently of the thermal initial condition, a section generally cools inhomogenously in air. The resulting different thermal length changes must be compensated by elastic or even elastic/plastic elongations, accompanied by the formation of stresses which occur as an inevitable result. The higher the temperature, the more quickly the stresses of this type are reduced by relaxation, i.e., by a process which is comparable to a concurrently occurring stress relief heat treatment. However, since this takes place more slowly than the thermal changes, internal stresses also act on the section during this phase of high temperatures. In the case of asymmetrical cooling conditions or section geometries, the section or rod assumes a shape because of the occurring distortion in which the inner moment becomes zero unless prevented therefrom by external forces, for example, weight forces, frictional forces or other holding forces, for example, as a result of a straightening grate.

If a fiber or a portion of the section is within the range of gamma-alpha structural transition, all stresses are canceled in this area because of the complete restructuring of the structure. The growth of this fiber caused by the lower packing density of the alpha iron is also partially suppressed because the other fibers which have not yet been transformed because of their residual elasticity resist against the growth of the fiber. In this phase of successively reaching the transformation range, the curvature of a section which asymmetrical or is cooled asymmetrically and is not guided in a straightening grate or other means continuously changes. Only toward the end of the transformation the section is essentially free of inherent stresses and is independent of the freely forming or forced state of curvature. However, when at least two fibers or partial areas have dropped below the lower limit temperature of the transformation, a constraint can again occur between these fibers which is the result of the elastic or elastic/plastic compensation of different thermally caused contractions. The stresses, later the inherent stresses, are essentially pressed below the transformation because of the relaxation which then becomes increasingly insignificant. As cooling progresses, more and more fibers drop out of the range of transformation and participate in the above-described formation of inherent stresses.

SUMMARY OF THE INVENTION

Therefore, it is the primary object of the present invention to provide a method which makes it possible to provide a section steel which has a uniform temperature distribution toward the end of the transformation.

In accordance with the present invention, prior to a final air cooling, a water cooling process is carried out in such a way that section steel portions with material concentrations are cooled at outwardly projecting portions of the steel sections over a width of application and a duration of application which are variable and subject to a predetermined cooling strategy supported by a process computer to a value which is at least still slightly above the transformation temperature Ar1.

DETAILED DESCRIPTION OF THE PRESENT INVENTION

For example, the outwardly projecting portions of steel sections are the flanges of double T sections and U sections. As a result of the method according to the present invention, a section is provided which is technically free from inherent stresses because of the selective cooling above the transformation temperature Ar1, preferably at the boundary of the lower transformation temperature, so that a homogenous temperature distribution is made possible because the steel sections are not treated until the cooled areas have used up the cooling supply and have thermally regenerated. Accordingly, in contrast to the known methods, the formation of internal stresses in the section no longer occurs, wherein these internal stresses are formed in the known method as a result of the essentially elastic or elastic/plastic compensation of different thermally caused expansions due to an inhomogeneous temperature distribution toward the end of the transformation. Consequently, the stability with respect to shape has improved with respect to the manufacture of the sectional girders as well as with respect to the further processing, for example, sawing. The fact that the section is essentially free of the inherent stresses toward the end of the transformation together with a uniform temperature distribution, results in a section which is almost free of internal stresses and, thus, is capable of carrying higher loads and is stable with respect to shape, even after complete cooling to room temperature and even if the temperature distribution was inhomogeneous in the interim.

The adjustment of the suitable temperature distribution is preferably effected by means of rows of spray nozzles which are arranged one behind the other in rolling direction and admit cooling water to the section at the desired locations or areas. Depending on the requirements, several spray nozzle rows may also be arranged next to each other and offset relative to each other, with different spacings in longitudinal direction or with different types of nozzles.

In accordance with a proposal of the present invention, for determining the width and duration of application and intensity necessary for the cooling strategy, the temperature of the section steel is determined and supplied to the process computer. For this purpose, the temperature distribution in the section is measured at the beginning of the process or, in the case of continuous plants, before the section enters the cooling stretch. This determination can be made either by measuring the temperatures of different section areas, by measuring a reference temperature and drawing an inference from a characteristic distribution, by computation taking into consideration the deformation technical prior history, or as a combination of these methods. Subsequently, using these inputs, the suitable cooling strategy is determined by means of the process computer, the cooling process is automatically activated at the correct time, the cooling process is varied as necessary in the case of changes of speed or changes of temperature over the length of the section, and the cooling process is finally concluded. The computation of the suitable cooling strategy can be achieved either on-line by means of software based on a physical model, or front-end computation results can be determined off-line in dependence on the type of section, assumed temperature distributions and material, the results can be implemented in the computer and the cooling intensity and duration can be determined by interpolation.

An adjustment to different types of sections, temperature situations, materials and speeds of the emerging section steel can be easily achieved if the last rolling mill required for rolling the section steel is followed by a water cooling stretch, particularly a continuous cooling stretch, which is preferably divided into cooling zones which can be individually controlled and switched on or off. The cooling stretch may also be composed of several cooling stretch sections. Moreover, a sufficient number of individually controllable zones makes it possible to control the process during changing conditions, such as the travel speed or the initial temperature distribution, while it is also possible to stand still, for example, of the rod end, within the cooling stretch.

In accordance with another proposal of the present invention, the size of the section steel surface area to which water is admitted is changed by changing the distance of the cooling water nozzles from the outer side of the section, and, in accordance with another proposal of the present invention, the cooling intensity is controlled by changing the pressure at which the water is supplied. Particularly in the case of larger sections, it is recommended, instead of providing only one row of nozzles on each side in travel direction, to equip the distribution pipes with several rows of nozzles which contributes to widening of the surface of admission of water and to a gradation of the cooling intensity. The position or pattern of the cooled path on the section steel defined by the impinging water jets can be adjusted by means of an appropriate device equipped with rotatable nozzle rows.

The manner of operation of the method according to the present invention as compared to the prior art is illustrated by the following two comparative examples:

1. Cooling of a section HEB 140 in air in accordance with the prior art.

Starting from a homogenous initial temperature distribution of $T_o$=900° C. and the material C 45, free cooling after dropping below the lower transformation temperature causes the hottest fiber to produce an inhomogeneous temperature distribution or intermediate temperature distribution which results in internal stresses, wherein the inhomogeneous temperature distribution produces residual stresses after complete cooling to room temperature (300 minutes). As a result, internal stresses in the amount of about 21% of the cold yield point of 460N/mm$^2$, interior, at the flange tips, i.e., independently of the ending axis at the outer fibers which, when external loads are to be absorbed, are always subjected to the highest loads. This initial load resulting from residual stresses substantially reduces the load carrying capacity of the finished girder.

2. Cooling a section HEB 140 in air after a prior water cooling according to the present invention.

Experiments have shown that, if under the same conditions as described above, the outer sides of the flanges are water cooled for the duration 6.7 seconds on a concentric path having a width of 80 mm and with correctly dimensioned intensity, a significantly more uniform temperature distribution can be achieved after completely undergoing the transformation. After complete cooling, the section has internal stresses which are at most only 5.6% of the cold yield point. Moreover, the stresses are substantially more uniform, particularly in the root area in which incipient cracks due to internal stresses frequently occur in sections cooled in conventional practice. For computing the relationship between stresses and elongations, in addition to the thermally caused length changes, all other processes which are relevant with respect to continuum mechanics, such as elasticity, plasticity and relaxation in dependence on the temperature.

The various features of novelty which characterize the invention are pointed out with particularity in the claims annexed to and forming a part of the disclosure.

The invention is not limited by the embodiments described above which are presented as examples only but can be modified in various ways within the scope of protection defined by the appended patent claims.

We claim:

1. A method of cooling section steel from rolling heat, the method comprising carrying out a water cooling procedure for cooling steel section portions having increased material widths at outwardly projecting portions thereof to a value which is at least slightly above the transformation temperature Ar1, whereby a cooling supply is imparted to the steel section portions, wherein the steel section portions are subjected to a width of application and a duration of application of water cooling which are variable and subject to a cooling strategy supported by a process computer, and carrying out cooling of the section steel in air to room temperature until the cooled steel section portions have used up the cooling supply and have thermally regenerated.

2. The method according to claim 1, for determining the width of application and duration of application and an intensity necessary for the cooling strategy, determining the temperature of the section steel and supplying the temperature to the process computer.

3. The method according to claim 1, wherein the water cooling procedure is carried out by means of cooling water nozzles directed toward the outwardly projecting portions of the steel sections, further comprising changing a size of a surface area of the section steel subjected to the water cooling procedure by changing a distance of the cooling water nozzles from the outwardly projecting portions of the steel sections.

4. The method according to claim 2, wherein cooling water is supplied with a supply pressure, further comprising controlling the cooling intensity by changing the supply pressure.

5. The method according to claim 1, wherein the water cooling procedure is carried out in a water cooling stretch, further comprising dividing the water cooling stretch into individually controllable cooling zones which can be switched on and off.

* * * * *